United States Patent [19]

Rath et al.

[11] 3,958,427

[45] May 25, 1976

[54] FRESH PRODUCE BARGE

[75] Inventors: Eric Rath, La Jolla, Calif.; George C. Mauder, Jr., Brooklyn, N.Y.

[73] Assignee: Frigitemp, New York, N.Y.

[22] Filed: Apr. 13, 1972

[21] Appl. No.: 243,695

[52] U.S. Cl. ..... 62/62; 62/91

[51] Int. Cl.[2] ..... F25D 17/06

[58] Field of Search ..... 62/239, 62, 514, 91, 62/127, 78

[56] References Cited

UNITED STATES PATENTS

| | | | |
|---|---|---|---|
| 3,246,592 | 4/1966 | Rath | 62/239 X |
| 3,521,459 | 7/1970 | Rath | 62/78 |
| 3,611,738 | 10/1971 | Maurer et al. | 62/64 |
| 3,699,870 | 10/1972 | Cantagallo et al. | 62/239 X |
| 3,715,891 | 2/1973 | Martin | 62/78 X |

*Primary Examiner*—William F. O'Dea
*Assistant Examiner*—Ronald C. Capossela
*Attorney, Agent, or Firm*—Herbert C. Schulze

[57] ABSTRACT

This is a method and device for carrying fresh produce in a fresh condition by barge upon waterways and particularly is characterized by a unique compartmentalized arrangement encompassing two air conditioning units and a single divisible produce compartment in which produce may be placed on pallets, wherein some of the pallets are utilized cooperatively with the air conditioning units to form plenum chamber ducts for the dispersion of the conditioned air.

7 Claims, 6 Drawing Figures

FRESH PRODUCE BARGE

CROSS REFERENCE TO RELATED PATENT APPLICATIONS

This patent application may be considered related to the following listed patent applications heretofore filed by one of the co-inventors, Eric Rath:

Ser. No. 141,956 Filed: May 10, 1971 now U.S. Pat. No. Re. 27457

For: Method for Storing and Transporting Food in a Fresh Condition (Application for Reissue of U.S. Pat. No. 3,521,459);

Ser. No. 164,568 Filed: July 21, 1971

For: Method and Device for Storing and Transporting Food in a Fresh Condition;

and

Ser. No. 209,082 Filed: Dec. 17, 1971

For: Fresh Produce Container Atmospheric Maintenance Unit

BACKGROUND OF THE INVENTION

1. Field of the Invention

This invention is in the field of transport of fresh produce and it is particularly in the field of transport of fresh produce by barge on waterways in conjunction with air conditioning units carried by such barge for maintaining the fresh condition of such produce.

2. Description of the Prior Art

There have been many air conditioned and/or air cooled or refrigerated fresh food containers in use, some of which have been the subject of patents. Some devices used in caring for fresh food containers are designed to be carried aboard ships; there are fresh food containers designed to be carried upon land vehicles; and some containers are so arranged as to be susceptible of being transported first upon land vehicles and then upon vessels.

The present invention, however, is in the unique field of a method and a combination with a barge of an arrangement suitable for transporting fresh food, by barge, either from initial point of production to point of destination, or intermediate other transport means or points. Up to now, attempts at conditioning the atmosphere of a barge for such use has been limited to cumbersome and ineffective blowing of air into a barge from a deck-mounted blower, or the like, which does little, if anything, to maintain proper conditions for fresh produce. We know of no art in which any attempt has been made to truly air condition a barge of produce effectively and to provide, at the same time, a plenum chamber distribution of conditioned air through the produce within the barge.

SUMMARY OF THE INVENTION

It is customary to transport much fresh produce from point of harvest, or any other suitable point, to the destination, to a point of storage, or other use, by water and barges. This is an economical means for such transport in many locations. One major problem in such transport, however, is spoilage of the produce.

Many barges used for produce transport are so constructed that they may be stacked one upon another. This has also placed a limitation upon the ability to condition the barges, or to move fresh air through them, since the attempts at conditioning have been aimed at the deck-mounting of large blowers, and the like, which makes it impossible to stack economically without a large space between the individual stacked barges.

It has been deemed most desirable to successfully effect proper conditioning of the atmosphere within and about the produce in a barge so that such produce may be maintained in proper condition for relatively long periods of time while remaining in such barge. Likewise, it has been deemed most desirable to condition the air within barges containing produce, since, in many instances, the regulations of the United States Department of Agriculture require that produce be maintained at a certain lowered temperature for given periods of time in order to effectively kill any fruit flies which may be present in such produce before entry into United States commerce. If it were possible to maintain such produce within barges in proper condition, as outlined, it would be possible to obviate the problem of spoilage and, also, possible to obviate any intermediate storage situations for produce during such time as the fruit fly control, as heretofore mentioned, was effected.

Among other problems in connection with the proper conditioning of air within barges, is the ever present problem of sea water or other water upon which the barge is being transported being carried into the fan or other conditioning unit, due to the necessity to have air circulation about such unit. This has been particularly difficult in connection with the type of barge which stacks one upon another, and there has been, up until our invention, a total lack of any effective means to circulate air as required, but at the same time to eliminate the danger of water coming into the unit from the deck or otherwise.

Our new development in this field and our invention herein includes a unique automatic opening and closing louver system for circulation of air together with a unique air intake system in which provision is made to trap and separate any water which might wash over the deck.

We have now developed a method and combination effective for the care of fresh produce within barges. We have alleviated various problems heretofore encountered in a most effective and unique manner. We have arranged for the division of the barge during times of air conditioning into two longitudinal compartments by the addition of a plastic sheet or the like running longitudinally the length of the barge and hanging from the top deck to the bottom of the barge and within the barge. We have placed one air conditioning unit on one side of the barge and at one end and a second air conditioning unit at the other end of the barge and at the other side. This unique placement balances the barges at all times. Likewise, we have placed a power unit and fuel tank in the end of the barge and near the opposite side from the air conditioning unit to service each of such air conditioning units. And, we have arranged for the elimination of contamination and flooding of the conditioning unit by water, as previously mentioned, and by a unique telescoping and sliding louver arrangement for air exit, and a unique double-walled air intake arrangement with water-trapping ability. The result is an overall balance heretofore not achieved with this possibility of air conditioning the cargo.

We have further arranged the air conditioning duct from the air conditioning unit in each instance so that it discharges the conditioned air through the pallets upon which produce is carried and stored within the barge, in which case, the pallets become an extension of the air conditioning ducts so as to allow a plenum chamber effect to be achieved wherein the conditioned air rises gradually throughout the entire produce and returns to the upper part of the air conditioning unit for further cooling and conditioning.

It is an object of this invention to provide a method and means to maintain fresh produce in proper condition within a barge;

It is a further object of this invention to provide such method and means wherein the pallets upon which produce is stored within the barge are utilized to form ducts for the transport of air from the air conditioning unit;

It is a further object of this invention to provide such method and means in such manner that the barge will be stable in the water whether loaded or empty;

It is a further object of this invention to provide a method, means, and combination as described with appropriate power and conditioning arrangements and detection equipment to maintain produce within a barge while satisfying certain agricultural control requirements.

The foregoing and other objects and advantages of this invention will be clear to those skilled in the art upon reading the following description of a preferred embodiment in conjunction with, and with reference to, the appended drawings.

DESCRIPTION OF A PREFERRED EMBODIMENT

Figure 1:
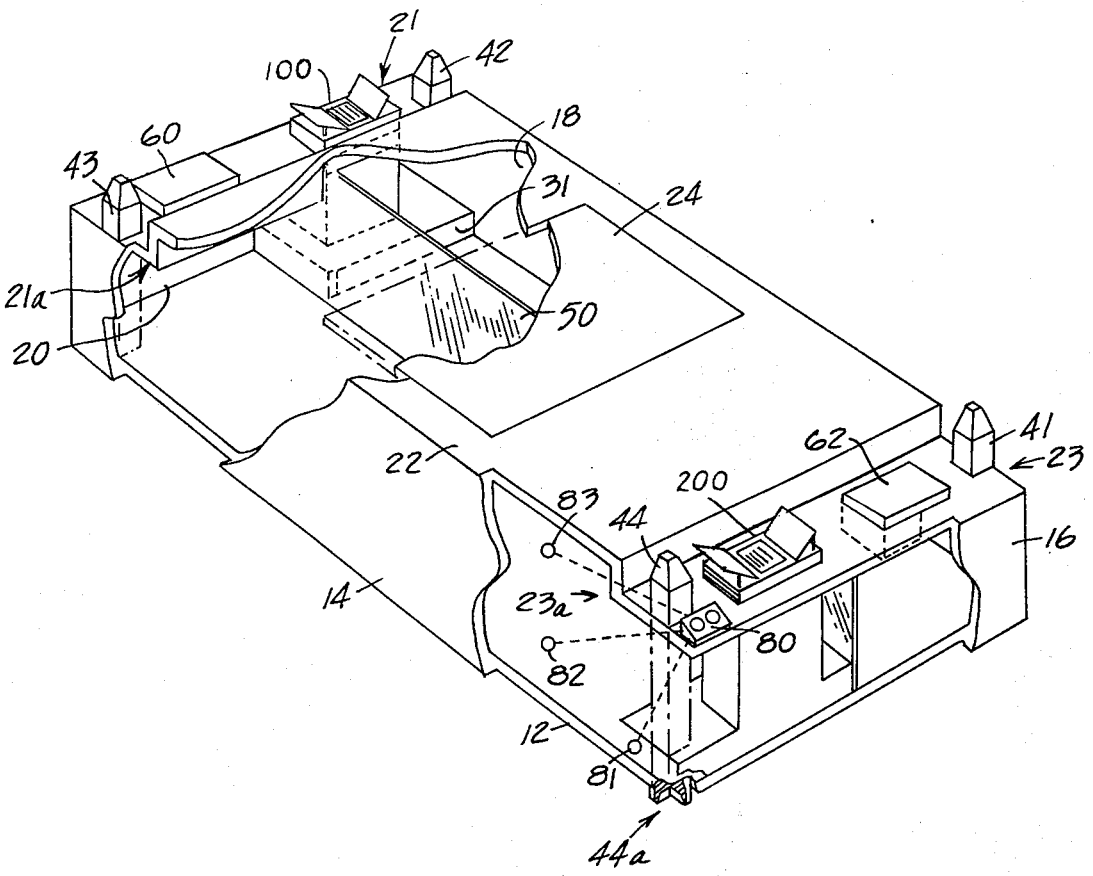
FIG. 1 is a partially broken away perspective of a preferred embodiment of a barge embodying the means of this method.

It will be observed from the FIGURES that the barge illustrated is relatively conventional in construction and consists of an essentially flat bottom 12 with sides and ends 14, 18, 16 and 20, together with a top deck 22 having a suitable opening enclosed by a hatch 24. The construction may be of welded steel, or the like, as is well-known in the barge industry and no attempt has been made to indicate the method of joining the various portions together, which are of no consequence in this particular invention. The top of the barge at each end will have a slight offset portion, as indicated at 21 and 23, with general configuration to provide the slightly lowered elevation at that position, as indicated at 21a and 23a. The reason for the lowering of this area is to provide for the clearances as indicated and in order to allow the upper portion of the air conditioning units 100 and 200 to be elevated essentially as indicated and the fuel tank and power combinations 60 and 62 to be located as indicated for accessibility. Such elevation also allows for the convenient stacking of one barge upon another by means of the corner posts 41, 42, 43 and 44, wherein the posts stack upon one another and thus the barges stack upon one another wherein the upstanding somewhat pyramidal shape of each of the posts at its top can enter and nest into the inverted pyramidal cavity at the lower end of each of said posts such as at 43*a* and 44*a*. The stacking of barges in this manner is not new as barges have been stacked in this manner heretofore.

In this particular instance, the offset of the deck at either end and as illustrated at 21, 21*a*, 23 and 23*a*, particularly accommodates for the proper mounting of the refrigeration and air conditioning units 100 and 200 and the fuel and power units 60 and 62. Likewise, this mounting allows the possibility of indicating panels or the like, such as illustrated at 80, in such condition that they are easily accessible, but cannot be damaged by elements upon the deck or coming close to the deck. In this particular instance, the control panel 80 is shown connected by dotted lines to sensing elements 81, 82 and 83 throughout the barge. It is noted that only two dials have been shown on the control unit 80 while three sensing elements have been illustrated at 81, 82 and 83.

There is no particular necessary relationship between the number of sensing elements and the number of dials, as each dial may operate from more than one sensing element and each sensing element may affect more than one dial. As an example, one of the dials illustrated could indicate a median between 81 and 83, which could be respectively sensing the condition of the freshly air conditioned air and the return air. Likewise, the element 82 could be sensing an intermediate condition or could even be sensing the condition within the produce, such as under conditions of control where agricultural requirements may require produce to be kept at a particular low temperature for a given period of time in order to completely eliminate any possibility of fruit fly or the like entering with the produce.

Figure 2:
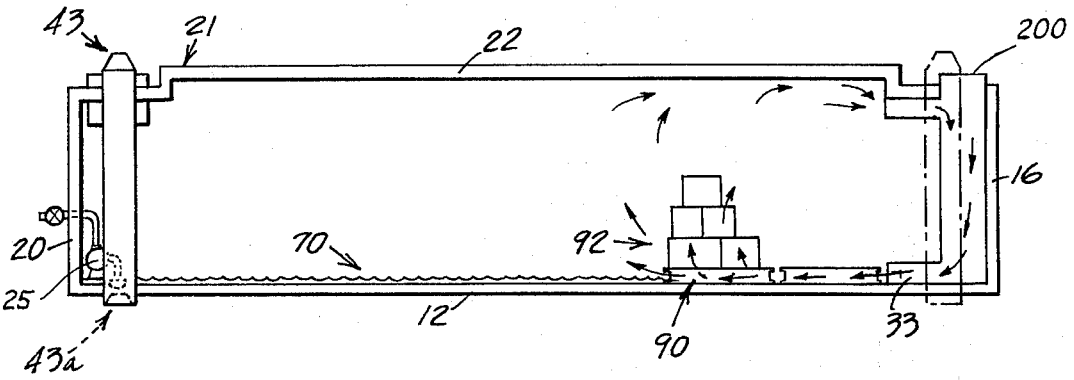
FIG. 2 is a side elevation of the embodiment shown in FIG. 1 with the side removed and some schematic indication of cargo and air flow within the unit.

In FIG. 2 there is particularly illustrated the air flow and this entire method is deemed unique. It will be observed that the duct 33, which receives the freshly refrigerated and otherwise conditioned air from the air conditioning unit 200 is so arranged that at its exit it aligns with pallets upon which the produce is stored and carried, which pallets are upon the floor of the interior of the barge during storage therein. As will be recognized by anyone familiar with pallets, these pallets would normally have longitudinal members, which would be so aligned as to run the direction of the length of the vessel and thus in the direction of the flow of the air from the air conditioner. Between each set of longitudinal members, a duct or a series of ducts will be formed through which the air from the air conditioning unit will travel as indicated schematically by the arrows in FIG. 2. Such pallets will also, normally, have openings of one type or another in their upper surface through which the conditioned air traveling through the lower portion of the pallet and between the cross members thereof may rise and thus circulate through and about the produce stored upon such pallets.

In the particular instance illustrated, the pallets will be for example 90 and produce may be in crates or the like, the details of which have not been shown, which crates may take a variety of shapes and are illustrated generally by the numeral 92.

As a result of cooling the air, there will be condensate from the air conditioning operation, as is well-known in the air conditioning art. The condensate is water condensed from the air as it is cooled and circulated. This condensate is allowed to collect upon the floor of the barge as a thin bath or layer of water 70 in which the pallets will be resting. There is an importance to allowing the collection of this water on the bottom of the barge, which has not previously occurred to others in this field, in that by maintaining this slight film of water in which the pallets rest, the air conditioned air, which has been greatly cooled, will not become overly dry, and the right balance of moisture within the air may be maintained. Such is not true of other systems or efforts to condition the produce air within a barge and the allowing of this slight bath of water from the condensate resulting from the air conditioning process is unique. A bilge pump 25 is provided so that as desired all, or a portion of the water 70 in the bottom of the barge may be removed in order to adjust and control humidity and the humidification process; thus maintaining the produce within an atmosphere of the correct desired humidity for the particular conditions of the produce itself and the ambient external conditions. No details of the bilge pump are shown, but it will be clear to those skilled in the art that such a pump may be so placed and its operation may be controlled by a humidity indicator so that the activation thereof will be dependent upon the humidity within the barge, if desired.

In operation, the air conditioning units 100 and 200, each of which will include a fan, or the like, to move the air, will draw in air at its uppermost portion, as indicated by the direction of the arrows flowing under the deck 22 of the barge. This air will then be forced downward as it is conditioned and as indicated by the direction of the arrows and through the duct 33, from whence it will travel through the ducts formed between the cross members of the pallets 90 and will travel the length of the barge, at the same time, passing over the water bath 70. The air will, throughout its course, filter upward, as indicated by arrows, so that some of the air will go through the entire barge; some will filter up through all of the produce and then all will return in an air flow as indicated.

Utilizing the pallets in this manner will cause them to be acting as plenum chambers by which a necessary pressure differential will be obtained to create an even and direct flow of the air and the continuous process of cooling.

It is understood that normally the produce will be loaded within the barge, the plastic curtain 50 will be placed in position, and both the conditioning units 100 and 200 will be activated. Any desired controls such as at the control unit 80, may be brought into play and by the use of appropriate sensing devices 81, 82 and 83, the appropriate condition for the particular produce or fruit fly control requirement may be achieved. The appropriate conditions as desired will be known to those skilled in the art and will include different temperature settings for different classes of food and will require the continuous existence of a particular temperature condition for the fruit fly control as required by the United States Department of Agriculture or others. These requirements are known to those skilled in the art of produce transportation and it will be clear that specific conditions required may be maintained for such periods of time as are deemed desirable.

A unique and very important problem encountered in attempts to freshen air within barges, is the difficulty of maintaining the integrity of the units being utilized to condition the air as against the action of waves and the like, breaking over the deck of the barge occasionally.

Additionally, all attempts to provide some sort of complex superstructure arrangement have been doomed to failure because of the necessity of stacking the barges upon the corner posts as previously mentioned.

We have overcome this problem and are now able to properly cool the air conditioning units' coils by circulation of large volumes of air. We are able to do this with adequate arrangements for stacking, and safeguards against the infiltration of water by means of a very unique combination of elements as will be herein described.

It is important to note, that we are showing the elements schematically, since we are not claiming uniqueness of air conditioning as such and all persons skilled in the art are familiar with the actions and operations of air conditioning units. For this reason, all details of this nature have been eliminated.

Figure 3:
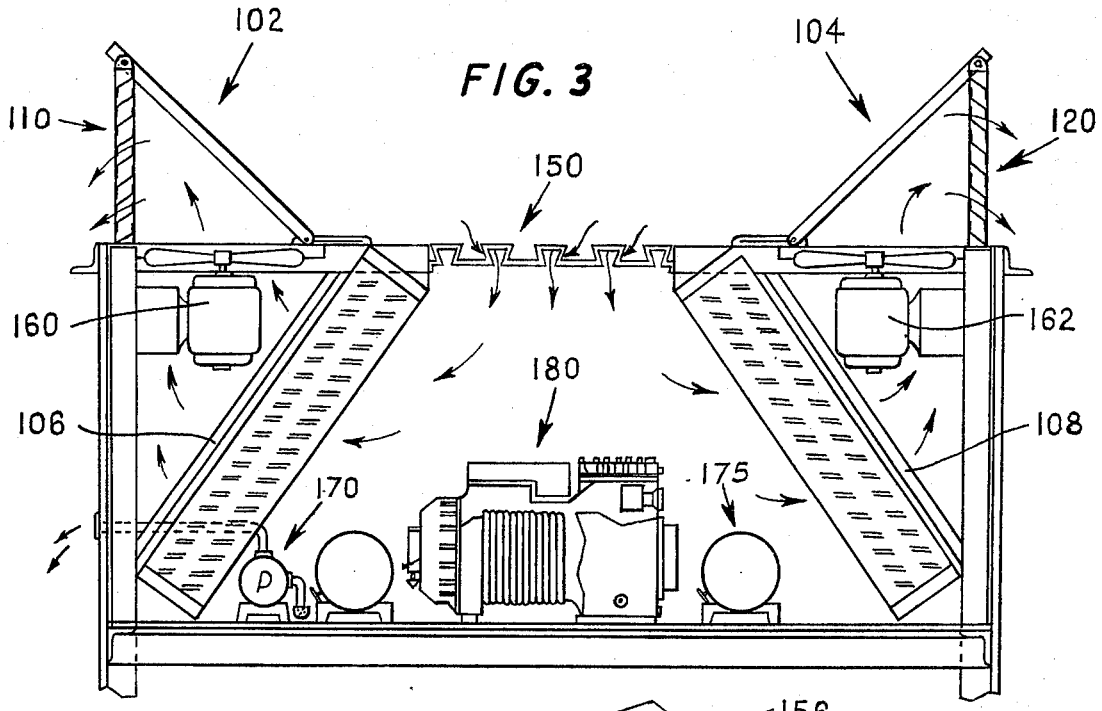
FIG. 3 is an enlarged, partially schematic view of a typical conditioning unit as used in the embodiment shown in FIG. 1 and FIG. 2, with the end removed to illustrate the elements of construction for ventilation of the condenser coils of the conditioning unit.

There is shown in FIG. 3 a typical air conditioning unit for one side of the barge. It is seen that the portion of the unit shown is the condenser coils, together with the compressor and tanks, and the like.

The compressor unit or units 180, together with suitable tanks such as 175, are located upon a platform below the deck of the barge. Beneath the portion specifically illustrated in FIG. 3, will be the cooling arrangement for the air being recirculated within the barge, and this will be clearly understood by those skilled in the art with no additional explanation.

Blowers 160 and 162 are provided to circulate air through the coil system 106 and 108 respectively. The air is blown upwardly and outward through the louvered arrangements 110 and 120. The air intake is through the air intake arrangement 150, the details of which will be explained below.

Figure 4:
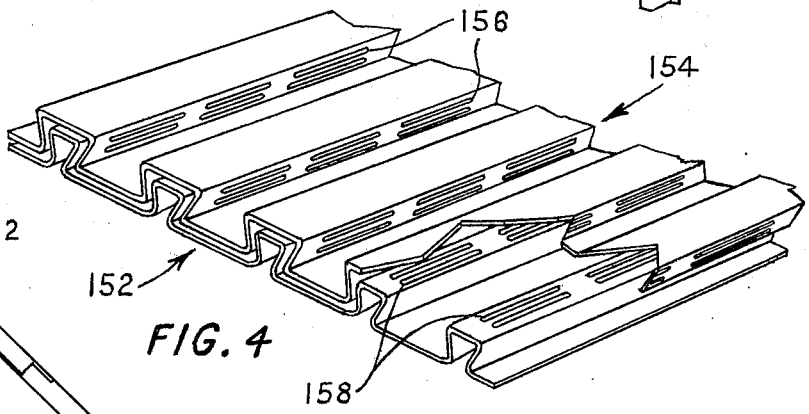
FIG. 4 is an enlarged, partially broken away view of a typical portion of the air intake arrangement for the condenser coils as shown in FIG. 3.

The air intake opening is constructed of a series of intercombined units as particularly illustrated in FIG. 4. It will be seen in FIG. 4, which is enlarged, partially broken away view of a portion of 150 from FIG. 3, that there is one basic item 152 of sheet metal, or the like, bent in approximately the configuration shown and having a multiplicity of openings such as 158 in each of the upper flat areas.

Nested above the unit 152, is a unit 154. This unit, again, has a configuration substantially as shown and with a series of openings 156 in its edges in a configuration such that such openings are upon an angular relationship of less than 90° with relationship to the horizontal top and bottom portions.

Thus, in the event that water should break over the top of the unit, very little, if any, of the water would enter through the openings 156. Any water which did enter through the openings 156, however, would drain down onto the flat trough-like arrangements of the lower element 152. Air, however, would be drawn through the openings 156 upward and around down through the openings 158 and thus would have been separated from the water which will then drain out through the troughs formed in the the lower portion of the unit 152. Any water which has splashed over the top and not gone through the slots 156 would, of course, drain through the flat troughs on the unit 154.

This water will then accumulate in a trough, not shown, at the end and will be drained out by gravity, or by the action of a bilge pump, not shown.

Additionally, a pump 170 is provided within the compressor compartment in the event that any water should, in spite of these precautions, enter that compartment, so that it may readily be pumped out in a manner well-known to those skilled in the art.

It is, of course, necessary to preserve the watertight integrity of this system, to prevent water from entering through the air exhaust portion, also. This has been accomplished by an upstanding series of louver arrangements 110 and 120, each of which consists of a series of elements formed of sheet metal, or the like, and bent at the angular relationship particularly shown in FIG. 6. At each end of the series of louver arrangements 114 is a channel 116 to provide an overall rigid unit. A channel is likewise provided at the bottom and at the top, as indicated in FIG. 5 in order to make one overall relatively rigid louver unit.

It will be seen that the effect of this louvered arrangement is to provide a passage for air being blown out by blowers 160 and 162 respectively so that in the event there was any splashing of water on the deck against this air escape arrangement, such water would have a relatively impossible task to find its way into the compressor compartment. The angular direction of the individual louvers 114 is such that the water will tend to drain back outside on the deck.

A deck cover 102 and 104 respectively is provided for each of the openings above the exhaust fans. This deck cover is mounted by a pin or hinged arrangement (details not shown) at or near the top of the louver arrangements 110 and 120 respectively. At its other end, it slides in a track 192 within a rigid mounting bar 190 and by means of a bolt or pin 194, by means which will be known in the art.

Figure 5:
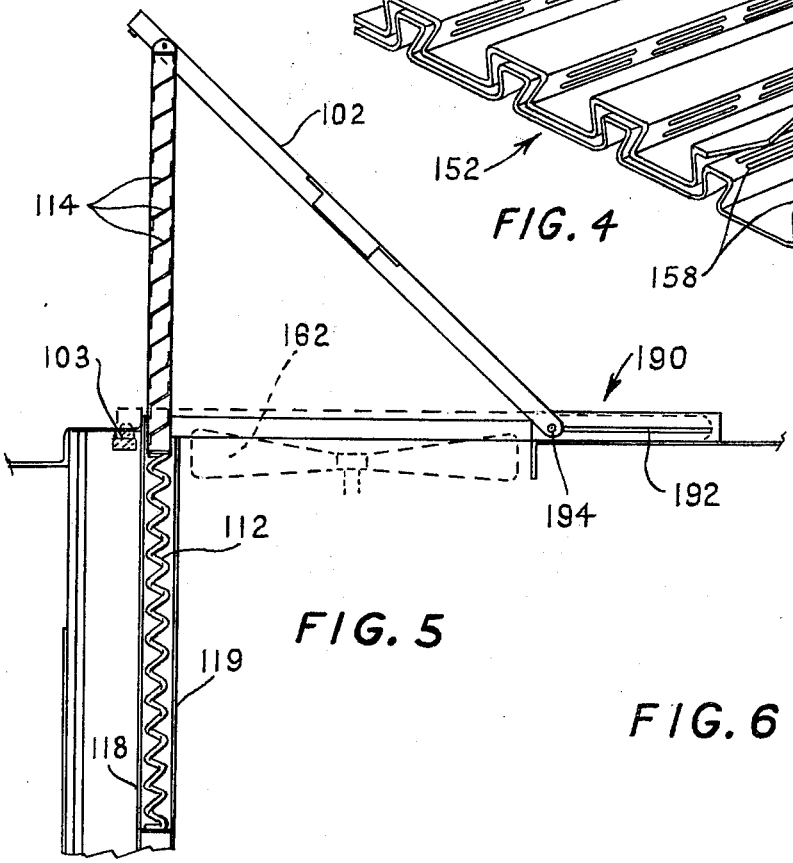
FIG. 5 is an enlarged, partially opened, schematic view of the air exhaust system shown in FIG. 3.
Figure 6:
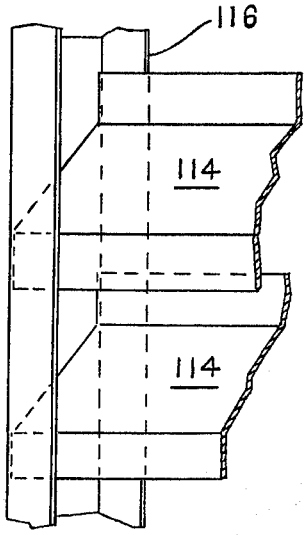
FIG. 6 is an enlarged view of a portion of one end of the louvered air exhaust arrangement of FIGS. 3 and 5.

A spring, or the like, 112, is mounted in a rectangular well formed of sheets of steel or the like, 118 and 119, as indicated particularly in FIG. 5. When one barge is stacked upon another with this arrangement, the covers 102 and 104 are pressed downward by the barge from above and the louver arrangements 110 and 120 disappear within the respective wells.

To avoid the possibility of inadvertent operation of the equipment when the louvers are closed, a contact switch, such as a microswitch, or the like, 103, will be provided to disconnect the power to the compressor unit 180 when the louver arrangement 114 has disappeared within its well and the contact switch is contacted by the covering element 102. It is understood that a like switch may be mounted in conjunction with the unit 120.

It is understood, of course, that the air circulating within the barge, and as shown by the arrows in FIG. 2 specifically, will enter the cooling portion of the air conditioning unit beneath the compressor platform as shown particularly in FIG. 3. The air circulation described is the cooling air for the coils and not the air being circulated within the barge. As previously expressed, the details of the operation of an air conditioning system are known to those skilled in the art and, therefore, such details are not shown.

It should be especially noted that the ducts formed by the spaces between the pallet cross members could conceivably be formed in another manner, such as by a series of specially constructed ducts and the like. In such instance, and in the event of the possibility of bulk loading of some products, such ducts would take the place of the pallets. While this is considered a possibility, it is to be noted that utilizing the pallets to supply the ducts for this purpose is an extreme advance in the art in itself in that it forms a completely cooperative arrangement between the produce and its carrier pallets, the barge, and the air conditioning unit.

Throughout this application, there have been references to power units, refrigeration units, and similar mechanical arrangements. There has not been any attempt to explain the details of workings of such items as are commonly known in the art. For example, each power unit will consist of a motor arrangement, together with fuel for the motor and a generator driven thereby and connected to the air conditioning unit. Such details of construction and alternatives thereto will be known to those skilled in the art and a specific detail of such construction is unnecessary to an understanding, and is not significant to the invention. Like statements will be made for other understood mechanical elements and cooperative arrangements, such as pins which slide in slots, hinge arrangements, air duct construction details, and the like. The fact that specific elements are mentioned is not intended to necessarily give them significance, and to eliminate from consideration elements which have not specifically been mentioned, which are, however, shown schematically or otherwise, and which are unnecessary to an understanding of the method and mechanism of this invention.

While the method and means particularly described are fully capable of achieving the objects and advantages desired with this invention, it will be understood that such method and the particular means shown are for the purposes of illustration only and not for purposes of limitation.

I claim:

1. The method of transporting produce in a fresh condition in a barge having a deck comprising storing fresh produce within a barge; cooling air and forcing the same under pressure along the floor of the inner portion of said barge in such manner that a plenum chamber effect is achieved and a portion of such air circulates upward throughout the entire length of said barge; and drawing the air so circulated through said barge along the lower side of the deck of said barge back to said air conditioning unit for further cooling and recirculation.

2. The method of claim 1 in which condensate from the air conditioning is allowed to accumulate on the floor of said barge such that the air passing over the same is humidified.

3. The method of claim 1 in which the produce is stored upon pallets which are aligned with the discharge opening from said air conditioning unit such that the spaces between cross members of the pallets become ducts for the transport of the cooled air along the length of the floor of the barge.

4. The method of claim 3 in which the characteristics of the freshly refrigerated air, of the return air and of air in the vicinity of the produce are sensed and recorded.

5. The method of claim 4 in which the characteristics of the produce itself are also sensed and recorded.

6. The method of claim 1 in which said barge is divided longitudinally with one air conditioning unit at one end of one of such compartments and a second air conditioning unit at the opposite end of the other of said compartments.

7. The method of claim 1 in which the characteristics of the air being circulated are sensed, controlled and recorded.

* * * * *